US011329422B2

(12) United States Patent
Komori et al.

(10) Patent No.: US 11,329,422 B2
(45) Date of Patent: May 10, 2022

(54) WIRE COVER AND CONNECTOR WITH WIRE COVER

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Hirokazu Komori, Mie (JP); Takahiro Murata, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/268,514

(22) PCT Filed: Aug. 1, 2019

(86) PCT No.: PCT/JP2019/030176

§ 371 (c)(1),
(2) Date: Feb. 15, 2021

(87) PCT Pub. No.: WO2020/039877

PCT Pub. Date: Feb. 27, 2020

(65) Prior Publication Data

US 2021/0265774 A1 Aug. 26, 2021

(30) Foreign Application Priority Data

Aug. 21, 2018 (JP) ..... JP2018-154454

(51) Int. Cl.
*H01R 13/58* (2006.01)

(52) U.S. Cl.
CPC ..... *H01R 13/58* (2013.01)

(58) Field of Classification Search
CPC ..... H01R 13/58
See application file for complete search history.

(56) References Cited

U.S. PATENT DOCUMENTS 5,731,546 A * 3/1998 Miles ..... H01R 9/2416 174/135
9,088,091 B2 7/2015 Suzuki et al.
(Continued)

FOREIGN PATENT DOCUMENTS

JP 2001-326020 A 11/2001
JP 2003-032866 A 1/2003
(Continued)

OTHER PUBLICATIONS

International Search Report dated Sep. 10, 2019 for WO 2020/039877 A1 (7 pages).

*Primary Examiner* — Briggitte R. Hammond
(74) *Attorney, Agent, or Firm* — Abelman, Frayne & Schwab

(57) ABSTRACT

A wire cover disclosed by this specification is for covering a plurality of wires pulled out from a housing, and includes a cover body into which the plurality of wires pulled out from the housing are introduced from front and from which the plurality of wires are drawn out in a rightward direction, and a guiding portion provided on an inner surface of the cover body and configured to guide small-diameter wires arranged to have shorter in-cover lengths, out of the plurality of wires, than a large-diameter wire on a left side arranged to have a longest in-cover length from a wire introduction position PI where the wire is introduced into the cover body to a wire draw-out position PO where the wire is drawn out
(Continued)

from the cover body, out of the plurality of wires to an extra length accommodation space provided in the cover body.

12 Claims, 4 Drawing Sheets

(56) References Cited

U.S. PATENT DOCUMENTS

| | | | |
|---|---|---|---|
| 2001/0023146 | A1 | 9/2001 | Verbeek et al. |
| 2013/0105219 | A1 | 3/2013 | Osawa et al. |
| 2015/0200496 | A1 | 7/2015 | Simpson et al. |

FOREIGN PATENT DOCUMENTS

| | | | |
|---|---|---|---|
| JP | 2004-319417 | A | 11/2004 |
| JP | 2015-095324 | A | 5/2015 |
| JP | 2016-076295 | A | 5/2016 |

* cited by examiner

WIRE COVER AND CONNECTOR WITH WIRE COVER

CROSS REFERENCE TO RELATED APPLICATIONS

This application is a national phase of PCT application No. PCT/JP2019/030176, filed on 1 Aug. 2019, which claims priority from Japanese patent application No. 2018-154454, filed on 21 Aug. 2018, all of which are incorporated herein by reference.

TECHNICAL FIELD

A technique disclosed by this specification relates to a wire cover and a connector with wire cover.

BACKGROUND

For example, a wire cover to be mounted on a connector is known from Japanese Patent Laid-Open Publication No. 2013-134961 (Patent Document 1 below). This wire cover guides and draws out a plurality of wires in a predetermined direction while protecting the plurality of wires by accommodating the plurality of wires pulled out rearward from a connector housing in a bent state.

PRIOR ART DOCUMENT

Patent Document

Patent Document 1: JP 2013-134961 A

SUMMARY OF THE INVENTION

Problems to be Solved

If lengths of the plurality of wires cannot be individually controlled and the plurality of wires having substantially the same lengths are accommodated in the wire cover, the wires having shorter in-cover lengths than the wire arranged to have a longest in-cover length from a wire introduction position of the wire cover to a wire pull-out position of the wire cover have extra lengths in the wire cover and extra-length parts tangle in the wire, thereby reducing the assembling workability of the wire cover.

A technique for suppressing the tangling of wires in a wire cover is disclosed in this specification.

Means to Solve the Problem

The technique disclosed by this specification is directed to a wire cover for covering a plurality of wires pulled out from a housing, the wire cover including a cover body into which the plurality of wires pulled out from the housing are introduced and from which the plurality of wires are drawn out in a direction intersecting an introducing direction of the plurality of wires, an extra length accommodation space provided in the cover body, and a guiding portion provided on an inner surface of the cover body, wherein, if a length from a wire introduction position where the wire is introduced into the cover body to a wire draw-out position where the wire is drawn out from the cover body is an in-cover length, the guiding portion guides at least one wire arranged to have a shorter in-cover length than a reference wire arranged to have a longest in-cover length, out of the plurality of wires, to the extra length accommodation space.

Further, the technique disclosed by this specification is directed to a connector with wire cover including a housing from which a plurality of wires are pulled, and the above wire cover.

According to this wire cover, the wire arranged to have the shorter in-cover length than the reference wire can be guided to the extra length accommodation space, which is originally a dead space, by the guiding portion, and an extra length of the wire can be routed in the extra length accommodation space. In this way, it is possible to suppress the tangling of the wires in the wire cover and prevent a reduction in the assembling workability of the wire cover.

The wire cover disclosed by this specification may be configured as follows.

The extra length accommodation space in the wire cover may be provided on a side opposite to the wire draw-out positions on the basis of the guiding portion, and the guiding portion may include an oblique portion inclined in a direction different from a direction toward the wire draw-out positions.

According to this configuration, a region, which is originally a dead space, on the side opposite to the wire draw-out position on the basis of the guiding portion in the cover body can be the extra length accommodation space for accommodating the extra length of the wire. In this way, it is not necessary to accommodate all the extra lengths of the wires in a region closer to the wire draw-out position than the guiding portion and it is possible to suppress the tangling of the extra lengths of small-diameter wires in the wire cover.

A plurality of the oblique portions may be provided to correspond to the respective wires, and an inclination start position of the oblique portion may be more away from the extra length accommodation space as the oblique portion is located closer to the wire draw-out position.

Generally, in the case of routing wires up to a distant position in an oblique direction in a wire cover, the shorter an obliquely routed part of the wire, the longer a wire path.

That is, the wire arranged to have a shorter in-cover length has a longer extra length, but an inclination start position of an oblique portion corresponding to the wire more distant from a reference wire is closer to an extra length accommodation space and has a longer wire path. Thus, extra lengths of the wires can be absorbed in a guiding portion and can be efficiently accommodated in a limited space inside the wire cover.

The plurality of wires may be pulled out from the wire cover while being covered by an outer coating for collectively covering the plurality of wires and a water sealing member for sealing between the plurality of wires and the outer coating on an end of the outer coating.

If the plurality of wires are fixed to the outer coating and the water sealing member and lengths of the plurality of wires pulled out from the housing cannot be changed in drawn-out parts of the wires as in this configuration, the above configuration is very effective.

Rubber plugs resiliently in close contact with the housing and the wires may be externally fit to the wires pulled out from the housing, and the guiding portion may include a holding portion for holding the wires pulled out from the housing straight in a pull-out direction of the wires.

If the rubber plugs are mounted between the housing and the wires, there is a concern that the rubber plug is deformed to reduce waterproof performance between the housing and the wire if the wire is bent.

However, since the wires having the rubber plugs externally fit thereto are held straight in the pull-out direction of the wires by the holding portion according to this configuration, the deformation of the rubber plugs can be prevented.

That is, it is possible to suppress the tangling of the wires in the wire cover by routing the extra lengths of the wires in the extra length accommodation space while preventing the deformation of the rubber plugs by the holding portions.

The housing may be provided with a locking portion for locking the wire disposed in the extra length accommodation space.

According to this configuration, the wire routed in the extra length accommodation space can be prevented from protruding from the extra length accommodation space and tangling by locking the extra length of the wire in the extra length accommodation space by the locking portion.

Effect of the Invention

According to the technique disclosed by this specification, it is possible to suppress the tangling of the wires in the wire cover.

DETAILED DESCRIPTION TO EXECUTE THE INVENTION

Embodiment

Figure 1:
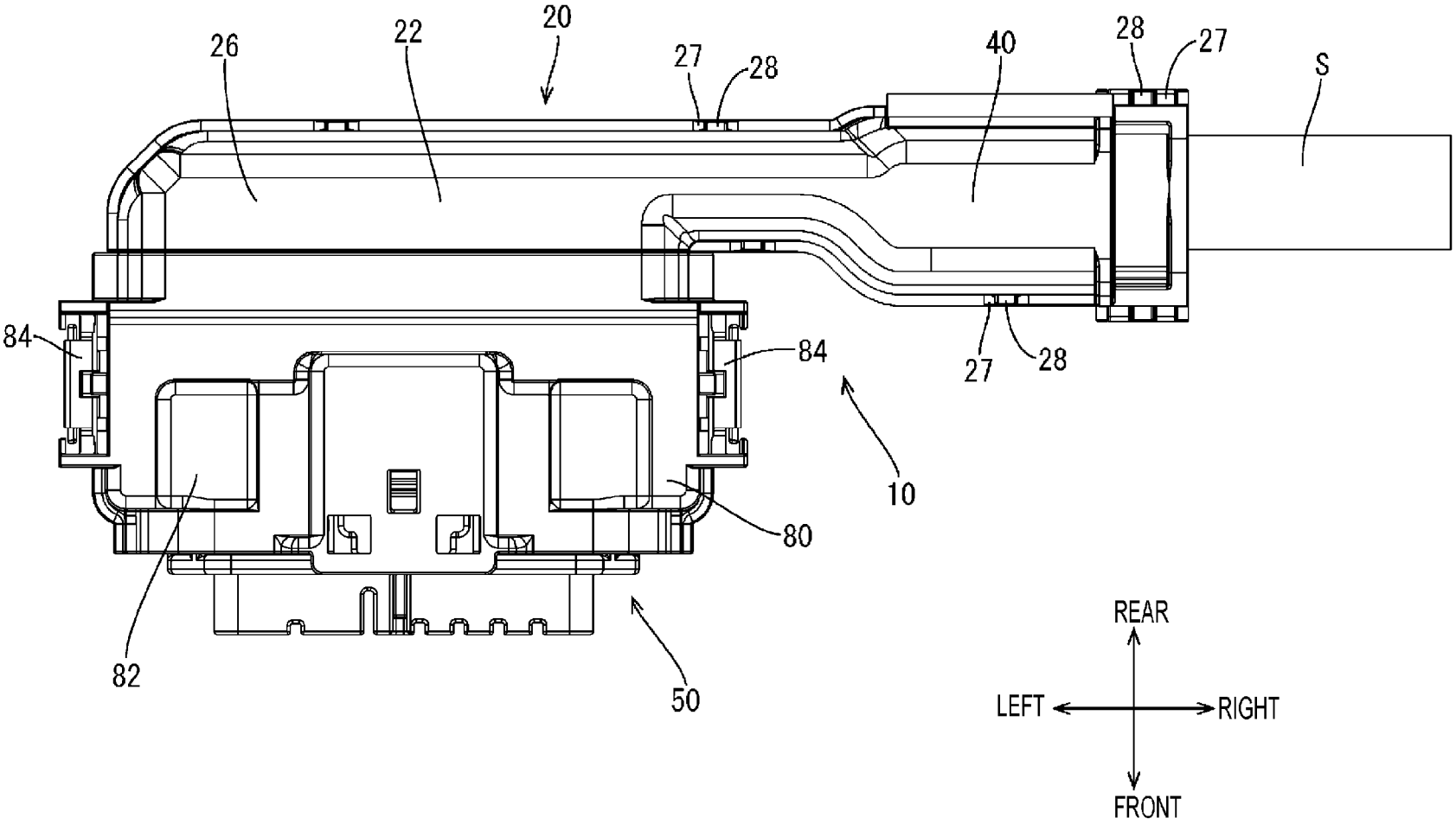
FIG. 1 is a plan view of a connector with wire cover.

One embodiment of the technique disclosed in this specification is described with reference to FIGS. 1 to 3.

A connector with wire cover 10 to be mounted in a place with a limited space of a vehicle such as a place near a tire is illustrated in this embodiment. As shown in FIGS. 1 to 3, the connector with wire cover 10 includes a housing 50 made of synthetic resin, a wire cover 20 for collectively covering a plurality of wires W pulled out rearward from the housing 50, and a joint cover 80 mounted over the housing 50 and the wire cover 20.

Figure 2:
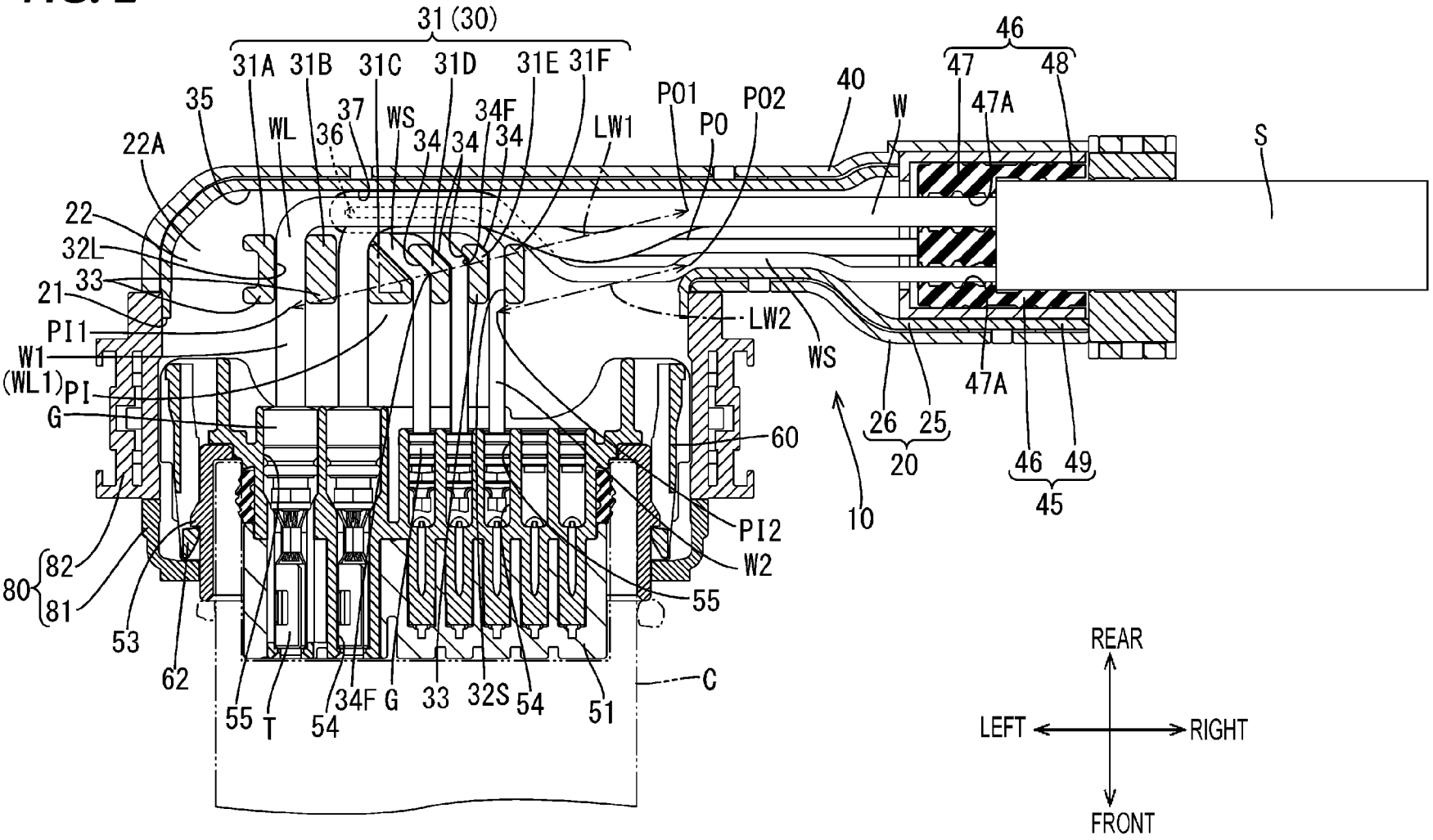
FIG. 2 is a section of the connector with wire cover.
Figure 3:
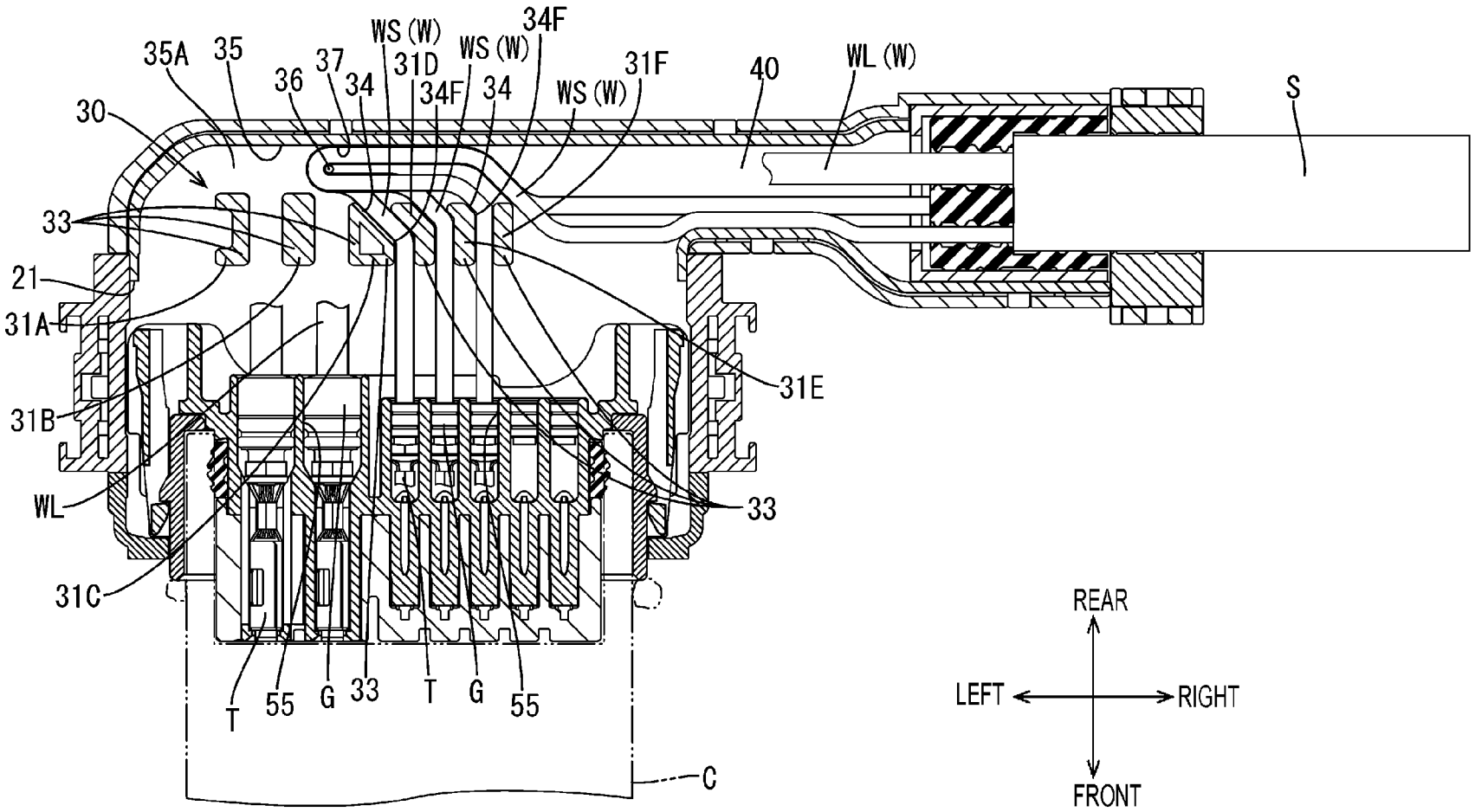
FIG. 3 is a section of the connector with wire cover showing a state where small-diameter wires are arranged in an extra length accommodation space.

As shown in FIGS. 2 and 3, the housing 50 is connectable to a mating connector C and includes an inner housing 51 fittable into the mating connector C and an outer housing 60 to be externally fittable to the mating connector C.

The inner housing 51 has a flat shape long in a lateral direction, and lock receiving portions 53 projecting laterally outward are provided on both lateral side walls of the inner housing 51.

Further, the inner housing 51 includes a plurality of cavities 54 into which female terminals T are accommodated. The respective cavities 54 are formed to extend in a front-rear direction and arranged side by side in the lateral direction. The cavity 54 is open in the front-rear direction, and the female terminal T is insertable through a rear end opening of the cavity 54. The female terminal T inserted into the cavity 54 is accommodated in a retained state by a known method, such as by an unillustrated locking lance. An unillustrated male terminal of the mating connector C is insertable through a front end opening of each cavity 54. A wire W connected to the female terminal T in each cavity 54 is drawn out rearward from the rear end opening of the cavity 54.

Further, a rear end part of the cavity 54 serves as a rubber plug accommodating portion 55 for accommodating a rubber plug G externally fit to an end of the wire W. If the rubber plug G externally fit to the wire W is accommodated into the rubber plug accommodating portion 55, the rubber plug G is held in close contact with the inner peripheral surface of the rubber plug accommodating portion 55 and the wire W, whereby the intrusion of water and the like into the cavity 54 through the rear end opening of the cavity 54 can be prevented.

Further, large-size female terminals T are accommodated into two cavities 54 on a left side, out of the plurality of cavities 54. Two wires W pulled out from the two cavities 54 on the left side are large-diameter wires WL, and three wires W pulled out from the other cavities 54 are small-diameter wires WS having smaller diameters than the large-diameter wires WL.

The outer housing 60 is formed into a tubular shape penetrating in the front-rear direction, and the inner housing 51 is fittable into the outer housing 60 from behind.

Locking pieces 62 to be locked to the lock receiving portions 53 of the inner housing 51 are provided on both lateral side walls of the outer housing 60. If the inner housing 51 is fit into the outer housing 60, the locking pieces 62 are locked to the lock receiving portions 53 in the front-rear direction as shown in FIGS. 2 and 3, whereby the inner housing 51 is held in the outer housing 60.

The wire 20 has an elongated shape longer in the lateral direction than the housing 50. A part of the wire cover 20 to the left of a substantially lateral central part serves as a cover body 22 including a wire introducing portion 21 open forward, and a part of the wire cover 20 to the right of the cover body 22 serves as a wire draw-out portion 40 extending rightward.

As shown in FIG. 2, the cover body 22 is configured such that, after a plurality of the wires W linearly extending rearward from the inner housing 51 are introduced into the cover body from the wire introducing portion 21, all the wires W are pulled out toward the wire draw-out portion 40.

Here, the wire WL disposed on a leftmost side, out of the plurality of wires W introduced into the cover body 22 from the wire introducing portion 21, has a longest in-cover length LW1 from a wire introduction position PI1 where the wire W is introduced into the cover body 22 to a wire draw-out position PO1 where the wire W is drawn out from the cover body 22 as shown in FIG. 2, and the in-cover length becomes shorter as the wire introduction position PI1 is shifted toward the right side. The wire WS disposed on a rightmost side, out of the plurality of wires W introduced into the cover body 22 from the wire introducing portion 21, has a shortest in-cover length LW2 from a wire introduction position PI2 to a wire draw-out position PO2.

The wire draw-out portion 40 has a substantially tubular shape and a water sealing member 45 is mounted in a right end part of the wire draw-out portion 40.

The water sealing member 45 includes a one-piece rubber plug 46 through which the plurality of wires W are inserted, and a cap 49 made of synthetic resin and to be externally fit to the one-piece rubber plug 46.

The one-piece rubber plug 46 has a substantially hollow cylindrical shape, a left half thereof serves as a wire insertion portion 47 having wire insertion holes 47A through which the plurality of wires W are respectively inserted, and a right half thereof serves as a sheath fitting portion 48 to be externally fit to a sheath (an example of an "outer coating") S for collectively covering the plurality of wires W.

The cap 49 has a substantially hollow cylindrical shape open in the lateral direction. The cap 49 is externally fit to the one-piece rubber plug 46, thereby pressing the one-piece rubber plug 46 radially inward and bringing the plurality of wires W, the sheath S and the one-piece rubber plug 46 into close contact to prevent the intrusion of water and the like from an end part of the sheath S.

Further, the wire cover 20 includes a lower wire cover 25 open upward and an upper wire cover 26 assembled with the lower wire cover 25 from above while being open downward. A plurality of cover lock portions 28 to be vertically locked to a plurality of cover lock receiving portions 27 provided on both front and rear side walls of the upper wire cover 26 are formed on both front and rear side walls of the lower wire cover 25, and the lower and upper wire covers 25, 26 are integrated to constitute the wire cover 20 by vertically locking the cover lock receiving portions 27 and the cover lock portions 28.

As shown in FIG. 2, the wire cover 20 is arranged at a position behind and slightly separated from the housing 50 and integrally fixed by the joint cover 80 assembled on a rear part of the housing 50 and the outer periphery of a front end part of the wire cover 20.

The joint cover 80 has a tubular shape open in the front-rear direction and is composed of a lower joint cover 81 having a U shape open upward in a front view and an upper joint cover 82 to be assembled with the lower joint cover 81 from above and having an inverted U shape in a front view.

A plurality of cover locking portions 84 to be vertically locked to a plurality of cover lock receiving portions 83 provided on both front and rear side walls of the lower joint cover 81 are formed on both front and rear side walls of the upper joint cover 82. When the upper joint cover 82 is assembled with the lower joint cover 81 from above, the cover locking portions 84 are vertically locked to the cover lock receiving portions 83 to integrally assemble the lower and upper joint covers 81, 82.

Further, the upper and lower joint covers 82, 81 are lockable to the rear part of the housing 50 and the front end part of the wire cover 20 in the front-rear direction.

Accordingly, by arranging the rear part of the outer housing 60 of the housing 50 and the front end part of the wire cover 20 on the lower joint cover 81 and assembling the upper joint cover 82 with the lower joint cover 81, the joint cover 80 is assembled on the rear part of the housing 50 and the outer periphery of the front end part of the wire cover 20 and the housing 50 and the wire cover 20 are integrally fixed by the joint cover 80.

Further, as shown in FIGS. 2 and 3, a guiding portion 30 provided behind the wire introducing portion 21 and a wire routing portion 35 provided behind the guiding portion 30 are provided in the cover body 22 of the wire cover 20, and the plurality of wires W are guided to the wire routing portion 35 by the guiding portion 30.

The guiding portion 30 includes a plurality of projecting portions 31 projecting from a bottom wall 22A of the cover body 22 into the cover body 22.

Six projecting portions 31 are provided side by side in the lateral direction to be disposed on both lateral sides of each of the plurality of wires W introduced into the cover body 22. The projecting portions 31 are successively a first projecting portion 31A, a second projecting portion 31B, . . . from left and the projecting portion 31 on a rightmost side is a sixth projecting portion 31F.

Accordingly, two large-diameter wire routing paths 32L having substantially the same gap dimension as outer diameters of the large-diameter wires WL are formed between adjacent ones of the first to third projecting portions 31A to 31C (three projecting portions 31 on the left side), and three small diameter wire routing paths 32S having substantially the same gap size as outer diameters of the small diameter wires WS are formed between adjacent ones of the third to sixth projecting portions 31C to 31F (four projecting portions 31 on the right side) as shown in FIG. 2.

The first, second and sixth projecting portions 31A, 31B and 31F extend in the front-rear direction, and lateral parts of the first, second and sixth projecting portions 31A, 31B and 31F on the side of the wires W serve as holding portions 33 extending straight in the front-rear direction.

A left part of the third projecting portion 31C serves as a holding portion 33 extending straight in the front-rear direction. A front end part of a right part of the third projecting portion 31C serves as a holding portion 33 extending straight in the front-rear direction, a part of the right part of the third projecting portion 31C rearward of the holding portion 33 serves as an oblique portion 34 inclined leftward (toward a side opposite to the wire introducing portion 21) toward the rear side (in a direction from which the wire W is pulled out from the housing 50).

Both left and right parts of each of the fourth and fifth projecting portions 31D, 31E are constituted by holding portions 33 extending straight in the front-rear direction and oblique portions 34 connected behind the holding portions 33. The oblique portions 34 of the fourth and fifth projecting portions 31D, 31E are also inclined leftward toward the rear side, similarly to the oblique portion 34 of the third projecting portion 31C, and angles of inclination of the oblique portions 34 of the third to fifth projecting portions 31C to 31E are all set at the same angle.

Further, the holding portions 33 from the right part of the third projecting portion 31C to the right part of the fifth projecting portion 31E become longer in the front-rear direction toward the right side. Associated with this, front end positions 34F, which are inclination start positions of the oblique portions 34, are shifted rearward.

Accordingly, as shown in FIG. 2, the two large-diameter wires WL introduced into the cover body 22 from the wire introducing portion 21 are arranged in the large-diameter wire routing paths 32L disposed therebehind and guided toward the wire routing portion 35 to be parallel to each other. On the other hand, the three small diameter wires WS are arranged in the small diameter wire routing paths 32S disposed therebehind and guided toward the wire routing portion 35 to be parallel to each other.

In particular, the two large-diameter wires WL are guided to the wire routing portion 35 while being held to extend straight rearward, which is a pull-out direction of the wires W from the housing 50, by the holding portions 33 of the first, second and third projecting portions 31A, 31B and 31C.

On the other hand, the three small diameter wires WS are guided to the wire routing portion 35 with front end parts thereof held in a state extending straight rearward by the holding portions 33 of the third, fourth, fifth and sixth projecting portions 31C, 31D, 31E and 31F and, thereafter, held in a state extending straight toward an oblique left-rear side by the respective oblique portions 34.

Further, since the front end positions 34F, which are the inclination start positions, of the oblique portions 34 from the right part of the third projecting portion 31C and the right part of the fifth projecting portion 31E are shifted rearward toward the right side, the position from which the oblique portion 34 extends toward the oblique left-rear side is located more rearward to make a length extending toward the oblique left-rear side shorter and make a wire routing distance up to the position of a later-described locking portion 36 of the wire routing portion 35 longer for the wire W having a shorter in-cover length, out of the three wires W.

As shown in FIGS. 2 and 3, the wire routing portion 35 is provided behind and adjacent to the guiding portion 30. A length in the front-rear direction of the wire routing portion 35 is set somewhat larger than the outer diameters of the large-diameter wires WL, and a vertical height thereof is so set that the plurality of wires W can be vertically arranged. That is, the wire routing portion 35 is formed to be larger in the vertical direction than in the front-rear direction.

The locking portion 36 projecting into the wire routing portion 35 from a bottom wall 35A of the wire routing portion 35 is provided in the wire routing portion 35. The locking portion 36 is in the form of an elongated round pin and arranged at a position somewhat to the left of a substantially lateral central part of the wire routing portion 35 and behind the large-diameter wire routing path 32L on the right side.

Further, the two large-diameter wires WL and the three small-diameter wires WS are introduced into the wire routing portion 35 from the guiding portion 30, and the two large-diameter wires WL are accommodated into the wire routing portion 35 in a state bent substantially at a right angle toward the right side and extending substantially straight up to the wire draw-out portion 40 after being introduced from the guiding portion 30.

On the other hand, the three small-diameter wires WS are bent toward the opposite left side and extend substantially straight up to the position of the locking portion 36 below the large-diameter wires WL after being introduced from the guiding portion 30, and accommodated into the wire routing portion 35 in a state extending substantially straight up to the wire draw-out portion 40 after being routed to wind clockwise around the locking portion 36.

That is, a space in the wire routing portion 35 where the three small-diameter wires WS are disposed (lower half space of the wire routing portion 35) serves as an extra length accommodation space 37 for accommodating extra lengths of the small-diameter wires WS having shorter in-cover lengths than the large-diameter wires WL on the left side having longer in-cover lengths. Further, the three small-diameter wires WS disposed in the extra length accommodation space 37 can be hooked to wind clockwise around the locking portion 36 from the right side, whereby the hooked small-diameter wires WS can be locked not to protrude from the extra length accommodation space 37 by being pulled rightward.

This embodiment is configured as described above. Next, functions and effects of the connector with wire cover 10 are described.

In a connector with wire cover in which a plurality of wires pulled out from a housing are bent in a wire cover, if lengths of the plurality of wires pulled out from the housing cannot be individually controlled and the lengths of all the wires W are substantially equal, the wires arranged to have shorter in-cover lengths from a wire introduction position of the wire cover to a wire draw-out position of the wire cover have extra lengths in the wire cover as compared to the wires arranged to have long in-cover lengths.

Figure 4:
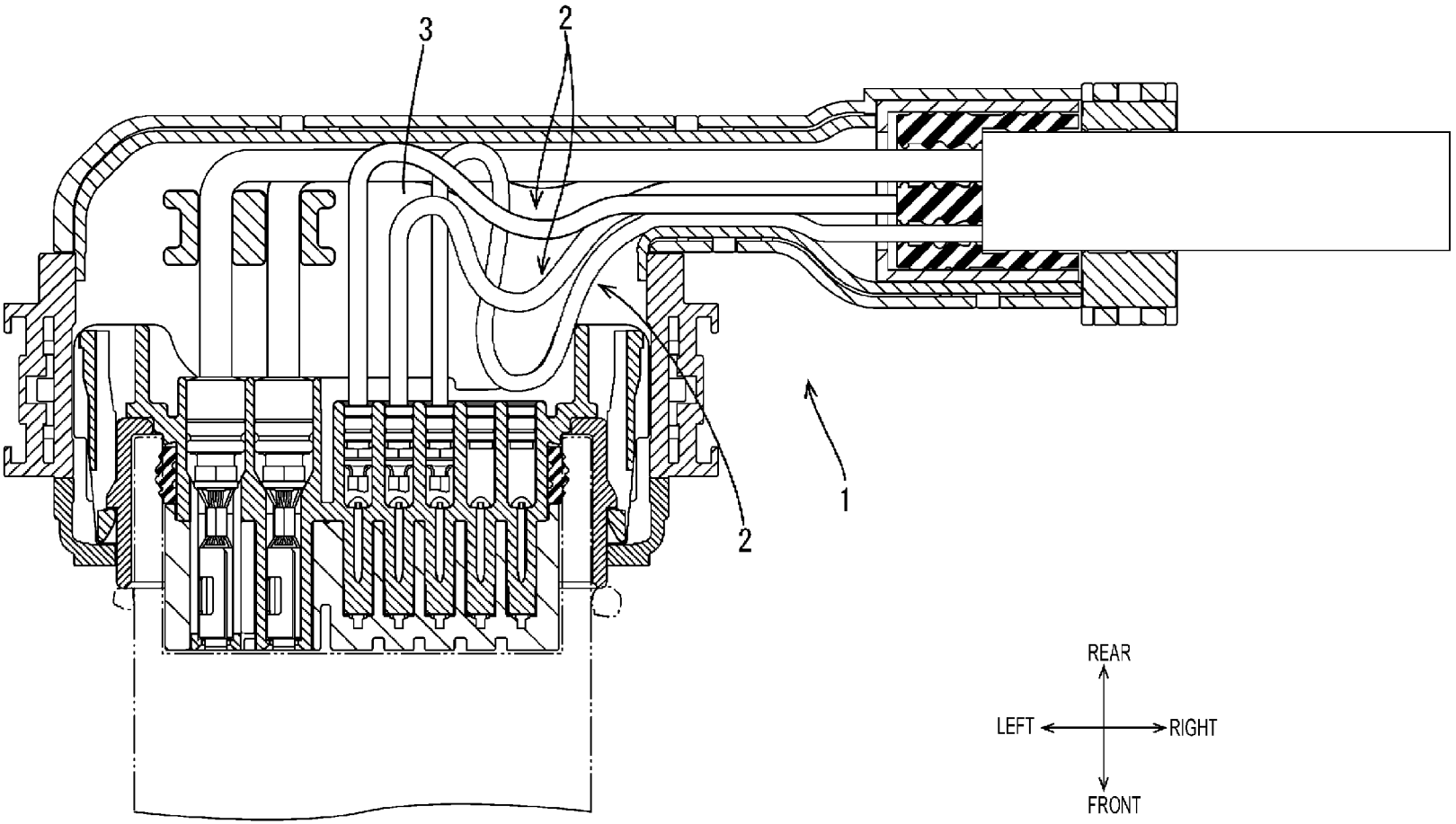
FIG. 4 is a section of a conventional connector with wire cover.

Accordingly, in a conventional connector with wire cover 1 configured not to guide extra lengths of wires 2 having shorter in-cover lengths to a space for accommodating the extra lengths of the wires 2 in a wire cover 3 as shown in FIG. 4, the extra lengths of wires 2 tangle in the wire cover 3. That is, in the conventional connector with wire cover 1, there is a concern of reducing the assembling workability of the wire cover 3.

To solve the above problem, this embodiment relates to the connector with wire cover 10 including the housing 50 from which the plurality of wires W are pulled out, and the wire cover 20 for covering the plurality of wires W pulled out from the housing 50, wherein the wire cover 20 includes the cover body 22 into which the plurality of wires W pulled out from the housing 50 are introduced and from which the plurality of wires W are drawn out in the direction (rightward direction) intersecting an introducing direction of the plurality of wires W, the extra length accommodation space 37 provided in the cover body 22, and the guiding portion 30 provided on the inner surface of the cover body 22, and the guiding portion 30 is configured to guide at least one wire (small-diameter wire WS) arranged to have a shorter in-cover length than a reference wire (large-diameter wire WL disposed on the left side) arranged to have a longest in-cover length, out of the plurality of wires W, to the extra length accommodation space 37 when a length from the wire introduction position PI where the wire W is introduced into the cover body 22 to the wire draw-out position PO where the wire W is drawn out is the in-cover length.

According to the wire cover 20 of the connector 10 with wire cover as in this embodiment, the small-diameter wires WS arranged to have shorter in-cover lengths than the reference wire (large-diameter wire WL on the leftmost side) can be guided to the extra length accommodation space 37, which is originally a dead space, of the wire routing portion 35 by the guiding portion 30 and the extra lengths of the small-diameter wires WS can be accommodated in the extra length accommodation space 37. In this way, it is possible to suppress the tangling of the small-diameter wires WS in the wire cover 20 and prevent a reduction in the assembling workability of the wire cover 20.

Further, the extra length accommodation space 37 of the wire routing portion 35 in the cover body 22 is provided on a side (left side) opposite to the wire draw-out positions PO on the basis of the guiding portion 30, and the guiding portion 30 includes the oblique portions 34 inclined toward the side opposite to the wire draw-out positions PO (leftward direction).

According to this configuration, a region, which is originally a dead space, on the side (left side) opposite to the wire draw-out positions PO (right side) on the basis of the guiding portion 30 in the cover body 22 can serve as the extra length accommodation space 37 for accommodating the extra lengths of the small-diameter wires WS. Thus, it is not necessary to accommodate all the extra lengths of the small-diameter wires WS in a region closer to the wire draw-out positions PO than the guiding portion 30 and it is possible to suppress the tangling of the extra lengths of the small-diameter wires WS in the wire cover 20.

Further, a plurality of the oblique portions 34 are provided to correspond to the respective small-diameter wires WS. The oblique portion 34 is arranged such that, the closer to the wire draw-out position PO, the more distant from the wire introduction position PI the front end position (inclination start position) of the oblique portion 34.

Generally, in the case of routing small-diameter wires up to a distant position in an oblique direction in a wire cover, the shorter an obliquely routed part of the small-diameter wire, the longer a wire path.

That is, the small-diameter wire WS arranged to have a shorter in-cover length has a longer extra length, but the front end position (inclination start position) 34F of the oblique portion 34 corresponding to the small-diameter wire WS arranged to have a shorter in-cover length is more distant from the wire introduction position PI and the wire path becomes longer. Thus, the extra length of each small-diameter wire WS can be absorbed in the guiding portion 30 and the extra lengths of the small-diameter wires WS can be efficiently accommodated in a limited space inside the wire cover 20.

Further, the plurality of wires W are pulled out from the wire cover 20 while being covered by the sheath (an example of the "outer coating") S for collectively covering the plurality of wires W and the water sealing member 45 for sealing between the plurality of wires W and the sheath S on the end of the sheath S.

If the plurality of wires W are fixed to the sheath S and the water sealing member 45 and the lengths of the plurality of wires W pulled out from the housing 50 cannot be individually controlled as in this embodiment, the configuration of this embodiment is very effective.

Further, the rubber plugs G resiliently in close contact with the housing 50 and the wires W are externally fit to the wires W pulled out from the housing 50, and the guiding portion 30 includes the holding portions 33 for holding the wires W pulled out from the housing 50 straight in the pull-out direction of the wires W (rearward direction).

If the rubber plugs G are mounted between the housing 50 and the wires W as in this embodiment, there is a concern that the rubber plug G is deformed to reduce waterproof performance between the housing 50 and the wire W if the wire W is bent.

However, since the wires W having the rubber plugs G externally fit thereto are held straight in the pull-out direction of the wires W by the holding portions 33 in this embodiment, the deformation of the rubber plugs G can be prevented.

That is, it is possible to suppress the tangling of the small-diameter wires WS in the wire cover 20 by routing the extra lengths of the small-diameter wires WS in the extra length accommodation space 37 while preventing the deformation of the rubber plugs G by the holding portions 33.

Further, the housing 50 is provided with the locking portion 36 for locking the small-diameter wires WS disposed in the extra length accommodation space 37.

According to this embodiment, the extra lengths of the small-diameter wires WS routed in the extra length accommodation space 37 can be prevented from protruding from the extra length accommodation space 37 and tangling by locking the extra lengths of the small-diameter wires WS in the extra length accommodation space 37 by the locking portion 36.

Other Embodiments

The technique disclosed in this specification is not limited to the above described and illustrated embodiment. For example, the following various modes are also included.

(1) In the above embodiment, the plurality of wires W include the large-diameter wires WL and the small-diameter wires WS. However, without limitation to this, a plurality of wires may include only large-diameter wires, only small-diameter wires or wires having three or more wire diameters.

(2) In the above embodiment, the wire W arranged to have the longest in-cover length is the large-diameter wire WL and the wire W arranged to have the shortest in-cover length is the small-diameter wire WS. However, without limitation to this, a wire arranged to have a longest in-cover length may be a small-diameter wire and a wire arranged to have a shortest in-cover length may be a large-diameter wire.

(3) In the above embodiment, the rubber plugs G are externally fit to the wires W. However, without limitation to this, no rubber plugs may be externally fit to wires.

(4) In the above embodiment, the end part of the sheath S covering the plurality of wires W is sealed by the water sealing member 45. However, without limitation to this, an end part of a sheath may be sealed by an adhesive or the like.

(5) In the above embodiment, the plurality of wires W introduced into the wire cover 20 are held in the state extending straight rearward by the holding portions 33. However, without limitation to this, wires may not be held by holders unless rubber plugs are externally fit to the wires.

(6) In the above embodiment, the small-diameter wires WS are arranged straight toward the oblique left-rear side by the oblique portions 34. However, without limitation to this, wires may be arcuately arranged to an oblique left-rear side.

(7) In the above embodiment, the housing 50 and the wire cover 20 are integrally fixed by the joint cover 80. However, without limitation to this, a wire cover may be directly fixed to a housing.

(8) In the above embodiment, the three small-diameter wires WS are guided by the guiding portion 30. However, without limitation to this, one, two, four or more wires may be guided by a guiding portion.

LIST OF REFERENCE NUMERALS

10: connector with wire cover
20: wire cover
22: cover body
50: housing
30: guiding portion
33: holding portion
34: oblique portion
34F: front end position (example of "inclination start position") of oblique portion
36: locking portion
37: extra length accommodation space
45: water sealing member
G: rubber plug
W: wire
WL: large-diameter wire on left side (example of "reference wire")
S: sheath (example of "outer coating")

What is claimed is:

1. A wire cover for covering a plurality of wires pulled out from a housing, comprising:

a cover body into which the plurality of wires pulled out from the housing are introduced and from which the plurality of wires are drawn out in a direction intersecting an introducing direction of the plurality of wires;

an extra length accommodation space provided in the cover body; and a guiding portion provided on an inner surface of the cover body, wherein:

if a length from a wire introduction position where the wire is introduced into the cover body to a wire draw-out position where the wire is drawn out from the cover body is an in-cover length, the guiding portion guides at least one wire arranged to have a shorter in-cover length than a reference wire arranged to have a longest in-cover length, out of the plurality of wires, to the extra length accommodation space, and the at least one wire extends toward a side opposite to the wire draw-out position and is folded 180° to extend toward the wire draw-out position in the extra length accommodation space after being drawn out from the guiding portion.

2. The wire cover of claim 1, wherein:

the extra length accommodation space in the wire cover is provided on a side opposite to the wire draw-out positions on the basis of the guiding portion, and the guiding portion includes an oblique portion inclined in a direction different from a direction toward the wire draw-out positions.

3. The wire cover of claim 2, wherein:

a plurality of the oblique portions are provided to correspond to the respective wires, and an inclination start position of the oblique portion is more away from the wire introduction position as the oblique portion is located closer to the wire draw-out position.

4. The wire cover of claim 1, wherein the plurality of wires are pulled out from the wire cover while being covered by an outer coating for collectively covering the plurality of wires and a water sealing member for sealing between the plurality of wires and the outer coating on an end of the outer coating.

5. The wire cover of claim 1, wherein:

rubber plugs resiliently in close contact with the housing and the wires are externally fit to the wires pulled out from the housing, and the guiding portion includes a holding portion for holding the wires pulled out from the housing straight in a pull-out direction of the wires.

6. The wire cover of claim 1, wherein the housing is provided with a locking portion for locking the wire disposed in the extra length accommodation space.

7. A connector with wire cover, comprising:

a housing from which a plurality of wires are pulled; and the wire cover of claim 1.

8. A wire cover for covering a plurality of wires pulled out from a housing, comprising:

a cover body into which the plurality of wires pulled out from the housing are introduced and from which the plurality of wires are drawn out in a direction intersecting an introducing direction of the plurality of wires;

an extra length accommodation space provided in the cover body; and a guiding portion provided on an inner surface of the cover body, wherein:

if a length from a wire introduction position where the wire is introduced into the cover body to a wire draw-out position where the wire is drawn out from the cover body is an in-cover length, the guiding portion guides at least one wire arranged to have a shorter in-cover length than a reference wire arranged to have a longest in-cover length, out of the plurality of wires, to the extra length accommodation space, the extra length accommodation space in the wire cover is provided on a side opposite to the wire draw-out positions on the basis of the guiding portion, the guiding portion includes an oblique portion inclined in a direction different from a direction toward the wire draw-out positions, a plurality of the oblique portions are provided to correspond to the respective wires, and an inclination start position of the oblique portion is more away from the wire introduction position as the oblique portion is located closer to the wire draw-out position.

9. The wire cover of claim 8, wherein the plurality of wires are pulled out from the wire cover while being covered by an outer coating for collectively covering the plurality of wires and a water sealing member for sealing between the plurality of wires and the outer coating on an end of the outer coating.

10. The wire cover of claim 8, wherein:

rubber plugs resiliently in close contact with the housing and the wires are externally fit to the wires pulled out from the housing, and the guiding portion includes a holding portion for holding the wires pulled out from the housing straight in a pull-out direction of the wires.

11. The wire cover of claim 8, wherein the housing is provided with a locking portion for locking the wire disposed in the extra length accommodation space.

12. A connector with wire cover, comprising:

a housing from which a plurality of wires are pulled; and the wire cover of claim 8.

* * * * *